United States Patent [19]

Nagashima et al.

[11] Patent Number: 4,543,915

[45] Date of Patent: Oct. 1, 1985

[54] COOLING FAN FOR RECOIL STARTER TYPE ENGINE

[75] Inventors: Akira Nagashima, Kawasaki; Toshio Taomo, Tokyo, both of Japan

[73] Assignee: Kioritz Corporation, Tokyo, Japan

[21] Appl. No.: 647,425

[22] Filed: Sep. 5, 1984

[30] Foreign Application Priority Data

Sep. 6, 1983 [JP] Japan ..... 58-137933[U]

[51] Int. Cl.[4] ..... F01P 1/02; F02N 3/02

[52] U.S. Cl. ..... 123/41.65; 123/179 SE

[58] Field of Search ..... 123/41.65, 41.66, 179 S, 123/179 SE

[56] References Cited

U.S. PATENT DOCUMENTS

| | | | |
|---|---|---|---|
| 3,183,902 | 5/1965 | Wicklund | 123/41.65 |
| 3,566,848 | 3/1971 | Dobbertin | 123/41.65 |
| 3,763,842 | 10/1973 | Dooley et al. | 123/179 S |
| 3,861,374 | 1/1975 | Dooley et al. | 123/179 S |
| 4,332,220 | 6/1982 | Itzrodt | 123/41.65 |
| 4,350,123 | 9/1982 | Kossek et al. | 123/2 |

*Primary Examiner*—William A. Cuchlinski, Jr.

*Attorney, Agent, or Firm*—Karl W. Flocks; Sheridan Neimark

[57] ABSTRACT

A cooling fan for a recoil starter type engine including a columnar projection formed at a front face of a magneto rotor of an ignition system mounted at a rotary shaft of an internal combustion engine, and a cylindrical portion for receiving the columnar projection and engaging an outer peripheral surface of the projection formed at a cooling impeller mounted at a front face of the magneto rotor. A keep plate forces a central portion of the cooling impeller against the magneto rotor, and the cylindrical portion of the cooling impeller is forced against the magneto rotor through a claw member engaging a recoil starter whereby the cooling impeller can be secured to the magneto rotor.

1 Claim, 1 Drawing Figure

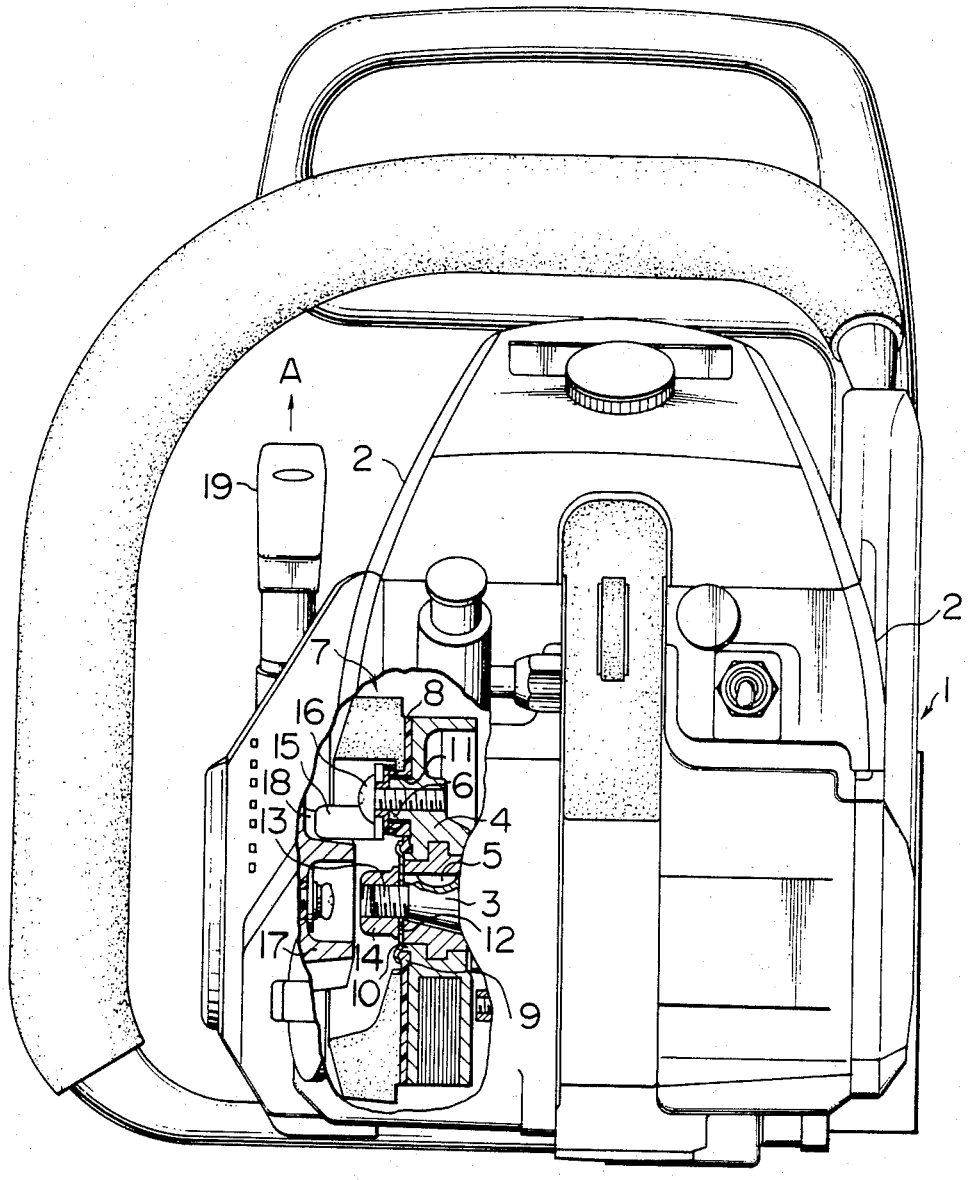
A
19
2
2
1
7
8
16
15
11
18
6
13
4
5
3
12
17
14
10
9

COOLING FAN FOR RECOIL STARTER TYPE ENGINE

BACKGROUND OF THE INVENTION

1. Field of the Invention

This invention relates to cooling fans for internal combustion engines started by recoil starters, and more particularly it is concerned with a cooling fan for a recoil starter type engine suitable for use with a portable power driven machine, such as a chain saw, a grass trimmer, etc., which uses an internal combustion engine as a power source.

2. Description of the Prior Art

In some types of cooling fans for recoil starter type engines of the prior art, attempts have been made to provide a magneto rotor of an ignition system of the engine and a cooling impeller as separate entities to promote common use of the parts and obtain an overall compact size in a cooling fan, and they are assembled together to provide a desired cooling fan. When this is the case, the work done to accomplish the object has often tended to defeat the purpose originally proposed to serve by increasing the thickness of the cooling impeller to avoid deformation of the fan or by adopting an interfitting structure or using a bonding agent to ensure that the parts are positively connected together.

SUMMARY OF THE INVENTION

Object of the Invention

This invention has as its object the provision of a cooling fan for a recoil starter type engine which is light in weight and in which deformation is minimized by virtue of the feature that the magneto rotor and cooling impeller of the prior art are formed into a unitary structure as much as is technically feasible.

STATEMENT OF THE INVENTION

The outstanding characteristics of the invention include a columnar projection formed at a front face of a magneto rotor of an ignition system mounted to a rotary shaft of an internal combustion engine, a cylindrical portion for receiving the columnar projection and engaging an outer peripheral surface of the projection formed at a cooling impeller attached to the front face of the magneto rotor, a keep plate for forcing a central portion of the cooling impeller against the magneto rotor, and a claw member engaging the recoil starter to force the cylindrical portion of the cooling impeller therethrough against the magneto rotor whereby the cooling impeller and claw member can be secured to the magneto rotor.

By virtue of the aforesaid outstanding characteristics of the invention including the columnar projection, cylindrical portion and keep plate, it is possible to accurately position the cooling impeller with respect to the magneto rotor and secure the cooling impeller to the magneto rotor through the claw member as a unitary structure. This makes it possible to reduce the thickness of the cooling impeller and avoid buckling deformation of the cooling impeller which is formed of synthetic resinous material.

BRIEF DESCRIPTION OF THE DRAWING

The single drawing is a rear view, with certain parts being broken away, of a chain saw incorporating therein the cooling fan for a recoil starter type engine comprising one embodiment of the invention.

DESCRIPTION OF THE PREFERRED EMBODIMENT

A preferred embodiment of the invention will now be described by referring to the single drawing accompanying the specification.

A chain saw generally designated by the reference numeral 1 comprises a machine frame 2 mounting therein an internal combustion engine, not shown, serving as a power source. A tapered end portion 3 of a rotary shaft of the internal combustion engine has secured thereto by means of a key 5 a magneto rotor 4 of an ignition system which is formed of an alloy of a light weight and produced by die casting. The magneto rotor 4 is formed integrally with a columnar projection 6 at a front face thereof, the columnar projection 6 being spaced radially from the axis of the rotary shaft.

A cooling impeller 7 is mounted at the front face of the magneto rotor 4 and formed of a synthetic resinous material. The cooling impeller 7 includes a base portion 8 in the form of a disc having an outer diameter which is substantially equal to the outer diameter of the magneto rotor 4. The base portion 8 of the cooling impeller 7 is maintained in engagement at an inner peripheral end 9 thereof with a boss 10 at an inner peripheral end of the magneto-rotor 4. Moreover, the base portion 8 of the cooling impeller 7 is formed with a cylindrical portion 11 in which is engaged the columnar projection 6 of the magneto rotor 4.

Mounted at a front face of the base portion 8 of the cooling impeller 7 is a keep plate 12, forcing the base portion 8 at a central portion thereof against the front face of the magneto rotor 4, which is formed with an opening allowing a threaded portion 13 formed at a forward end portion of the tapered end portion 3 of the rotary shaft of the internal combustion engine to extend therethrough. A nut 14 is threadably connected to the threaded portion 13 that has extended through the opening in the keep plate 12 so as to force the inner peripheral end 9 of the base portion 8 of the cooling impeller 7 against the magneto rotor 4 through the keep plate 12 to thereby form the cooling impeller 7 and magneto rotor 4 as a unitary structure.

A screw 16 forces the base portion 8 of the cooling impeller 7 against the magneto rotor 4 through a claw member 15 to secure the parts together as a unit, to provide a cooling fan.

A recoil starter 17 located close to the cooling impeller 7 is mounted coaxially with the cooling impeller 7 on the machine frame 2 for rotation. The recoil starter 17 which is of known type is formed at a surface thereof facing the cooling impeller 7 with a recess 18 which the claw member 15 engages. The recoil starter 17 has a starting wire 19 which is wound in coil form by the biasing force of a spring, not shown.

In starting the internal combustion engine of the chain saw 1, the starting wire 19 is pulled upwardly in the direction of an arrow A against the biasing force of the spring, to rotate the recoil starter 17 in one direction. The rotation of the recoil starter 17 is transmitted through the claw member 15 engaging the recess 18 to the magneto rotor 4 and the end portion 3 of the rotary shaft, whereby the internal combustion engine can be started.

What is claimed is:

1. A cooling fan for a recoil starter type engine comprising:

a columnar projection formed at a front face of a magneto rotor of an ignition system mounted to a rotary shaft of an internal combustion engine;

a cylindrical portion for receiving said columnar projection and engaging an outer peripheral surface of the projection formed at a cooling impeller mounted to the front face of the magneto rotor;

a keep plate for forcing a central portion of the cooling impeller against the magneto rotor; and a claw member connected to said projection and engaging a recoil starter to force the cylindrical portion of the cooling impeller against the magneto rotor whereby the cooling impeller can be secured to the magneto rotor.

* * * * *